US006953517B1

(12) United States Patent
Boretzky et al.

(10) Patent No.: US 6,953,517 B1
(45) Date of Patent: Oct. 11, 2005

(54) PLANT FOR THE TREATMENT OF RESIDUE

(75) Inventors: Joachim Boretzky, Adelsdorf (DE); Anton Ebert, Ellwangen-Schrezheim (DE); Leonhard Teschers, Gundelfingen/Donau (DE); Winfried Von Rhein, Freigericht (DE); Helmut Werdinig, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 653 days.

(21) Appl. No.: 09/718,896

(22) Filed: Nov. 22, 2000

Related U.S. Application Data

(63) Continuation of application No. PCT/DE99/01450, filed on May 12, 1999.

(30) Foreign Application Priority Data

May 22, 1998 (DE) ..... 198 22 991

(51) Int. Cl.[7] ..... C10B 21/18; C10B 33/00

(52) U.S. Cl. ..... 201/3; 422/900; 209/19; 209/44.3; 209/682; 209/142; 209/3; 209/12.1; 209/39; 209/138; 209/30; 209/31; 209/32; 209/33; 209/34; 209/35; 209/36; 209/37; 110/259; 110/263; 201/28

(58) Field of Search ..... 422/900; 201/3; 209/19, 44.3, 682, 142, 3, 12.1, 39, 138, 209/30–37; 110/259, 263

(56) References Cited

U.S. PATENT DOCUMENTS 4,077,847 A 3/1978 Choi et al. ..... 201/21
5,184,780 A * 2/1993 Wiens ..... 241/19

* cited by examiner

*Primary Examiner*—Glenn Caldarola
*Assistant Examiner*—Alexis Wachtel
(74) *Attorney, Agent, or Firm*—Laurence A. Greenberg; Werner H. Stemer; Ralph E. Locher

(57) ABSTRACT

In order to make it possible for an inhomogeneous residue generated in a pyrolysis plant to be separated continuously and in as fully graded a way as possible, specially selected components are combined with one anther in an advantageous configuration. An essential element of the plant is the separation of a coarse residue in a coarse screen and the subsequent separation of the remaining residue in a zigzag separator into a light residue and a heavy residue. By use of the plant, in particular, the carbon-containing constituents are separated from the remaining residue. The individual components are mostly configured to be self-cleaning for fault-free operation.

7 Claims, 5 Drawing Sheets

PLANT FOR THE TREATMENT OF RESIDUE

CROSS-REFERENCE TO RELATED APPLICATION

This is a continuation of copending International Application PCT/DE99/01450, filed May 12, 1999, which designated the United States.

BACKGROUND OF THE INVENTION

Field of the Invention

The invention relates to a plant for the treatment of inhomogeneous residue from a thermal waste disposal plant, in particular from a pyrolysis plant.

Published, European Patent Application EP 0 302 310 A and the company publication titled "Die Schwel-Brenn-Anlage, eine Verfahrensbeschreibung" ["The Low-Temperature Carbonization Incineration Plant, A Process Description"], published by Siemens AG, Berlin and Munich, 1996, disclose, as a pyrolysis plant, a so-called low-temperature carbonization incineration plant, in which essentially a two-stage process is carried out. In the first stage, the waste delivered is introduced into a low-temperature carbonization drum (pyrolysis reactor) and is carbonized at a low temperature (pyrolysed). During pyrolysis, a low-temperature carbonization gas and a pyrolysis residue occur in the low-temperature carbonization drum. The low-temperature carbonization gas is burnt, together with combustible parts of the pyrolysis residue, in a high-temperature combustion chamber at temperatures of approximately 1200° C. The waste gases obtained at the same time are subsequently purified.

The pyrolysis residue has a large proportion of incombustible constituents that are composed essentially of an inert fraction, such as glass, stone or ceramic, and of a metal fraction. The latter contains a ferrous fraction and a non-ferrous fraction. It is known to separate the individual fractions of the incombustible constituent from one another and to deliver them, if possible to a great extent fully graded, for reutilization.

For separating and sorting the residue, it is necessary to have a plant for the treatment of residue, which is capable, in a continuous process, of separating the highly inhomogeneous pyrolysis residue occurring during the pyrolysis process. For ecological reasons, the aim is, in particular, to achieve as complete a separation as possible of the combustible carbon-containing constituents that can, for example, be utilized for energy purposes. The quantity of residue to be dumped is thereby kept as small as possible. Due to the high inhomogeneity of the residue, which has pronounced differences as regards its material composition, its size and the geometry of its residue fragments, it is essential to co-ordinate the individual components of the plant with one another, in order to ensure that the plant operates continuously and reliably, and in order to avoid a breakdown of the plant caused by components which may have become blocked.

SUMMARY OF THE INVENTION

It is accordingly an object of the invention to provide a plant for the treatment of residue which overcomes the above-mentioned disadvantages of the prior art devices of this general type, which ensures reliable and continuous separation of the residue, without blockages of individual components occurring.

With the foregoing and other objects in view there is provided, in accordance with the invention, a treatment plant containing a coarse screen receiving an inhomogeneous residue from a thermal waste disposal plant. The coarse screen separates the inhomogeneous residue into a coarse residue and a remaining residue. An air separator is disposed downstream of the coarse screen and receives the remaining residue. The air separator has a zigzag-shaped duct with an upper outlet and a lower outlet and through which air is capable of flowing. The zigzag-shaped duct separates the remaining residue into a light residue flowing toward the upper outlet and a heavy residue flowing toward the lower outlet. An air separator drum is connected to the lower outlet and through which the air can flow. The air separator drum has a longitudinal axis, an inner wall, and drivers disposed on the inner wall, and the air separator drum is mounted rotatably about the longitudinal axis.

The coarse screen serves for separating the coarse residue from the inhomogeneous residue. The remaining fine residue is separated into a light residue and a heavy residue in the air separator which is also known as a zigzag separator. The prior separation of the coarse residue is enormously important for the operating capacity of the air separator, since the coarse residue may become jammed in the duct of the air separator. The fine residue introduced into the zigzag separator has a largely homogeneous size distribution.

In order to separate the heavy residue from the light residue, air flows at a suitable flow velocity through the duct from the lower outlet towards the upper outlet. Depending on the flow velocity and the specific gravity of the individual residual fragments, the light residual fragments are carried by the air towards the upper outlet, whereas the heavy residual fragments fall downwards. A decisive advantage of the zigzag-shaped configuration is that even sheet-like heavy residual fragments, such as, for example, crown corks, are reliably separated.

In order to ensure particularly reliable separation of course residual fragments in the coarse screen, without the risk of blockage, the coarse screen preferably has a rod which is wound to form a spiral and which extends in the direction of its spiral axis and can be rotated about the latter. In addition, it advantageously has an aligning device for the alignment of elongate solid fragments, the aligning device is disposed in front of the spiral and opening into the interior of the latter. The aligning device is configured, in particular, as a drum. A coarse screen configured in this way is referred to as a spiral screen. The spiral screen is described in the German Patent Application bearing the official file number DE 198 23 018.4 and is hereby incorporated by reference. The spiral screen may also have a plurality of rods which are disposed in the form of a spiral or part-spiral and which, for example, commence in each case at the drum end of the aligning device and are disposed so as to be offset relative to one another. The part-spirals preferably do not have a complete turn, but preferably possess an angle of rotation smaller than 180°.

In a preferred development of the plant, the upper outlet has connected to it a centrifugal screen, in which a rotor is disposed in a housing and a sheet-like screen is disposed between the rotor and housing.

As a result of the rotational movement of the centrifugal screen, the light residual fragments supplied to it are thrown outwards in the direction of the screen due to the centrifugal acceleration. The screen ensures separation into two fractions of different grain sizes. In order to make it possible for residual fragments to be comminuted in the centrifugal screen, battens are advantageously fastened to the rotor.

Preferably, the centrifugal screen has a balling zone and a grinding zone, the sheet-like screen being disposed around the rotor in the region of the grinding zone. The grinding zone, in particular, follows the balling zone. Both the balling zone and the grinding zone have battens in an advantageous embodiment. In the balling zone, for example sheet-like aluminum foils are shaped into small balls, so as to avoid clogging screen holes of the screen with sheet-like aluminum foils. In the grinding zone, in particular carbon-containing constituents are comminuted with the aid of the battens and can then pass through the screen.

An essential advantage of the combination of the coarse screen, the zigzag separator and the centrifugal screen is that a large proportion of the carbon-containing residue constituents is separated, these being utilized thermally, for example in a combustion chamber.

In a further preferred embodiment, the lower outlet has connected to it an air separator drum, through which air is capable of flowing and which is mounted rotatably about its longitudinal axis and on the inner wall of which drivers are disposed.

The heavy residue is stirred up in the air separator drum, so that light residue still adhering is released. Air flows through the air separator drum towards the lower outlet of the zigzag separator, so that the light residual fragments are entrained and carried upwards in the zigzag separator.

Furthermore, a separating device for separating the residue into an inert fraction and into a ferrous and non-ferrous fraction is advantageously connected to the lower outlet and, in particular, after the air separator drum. The heavy residue, which is largely freed of carbon-containing dust constituents by the preceding components, is supplied to the separating device, so that virtually fully graded sorting is then possible.

Any carbon-containing residues still present are mainly contained in the inert fraction. In order to recover the carbon constituents that have remained, in a preferred embodiment the separating device has an inert screen for the further screening of the inert fraction. By use of the latter, a fine and relatively carbon-rich fraction is separated and is supplied, for example, for further inert purification in order to separate the carbon which is still present.

In a preferred version, the inert screen used is a screen designated as a chain screen, such as is described in the German Patent application bearing the official file number 198 23 019.2 and entitled "Trennvorrichtung und Verfahren zum Trennen von Feststoff" ["Separating Device And Method For The Separation Of Solids"], which is hereby incorporated herein. The chain screen described in it is configured essentially as a continuously rotating lattice with fall-through orifices for the solids.

Other features which are considered as characteristic for the invention are set forth in the appended claims.

Although the invention is illustrated and described herein as embodied in a plant for the treatment of residue, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
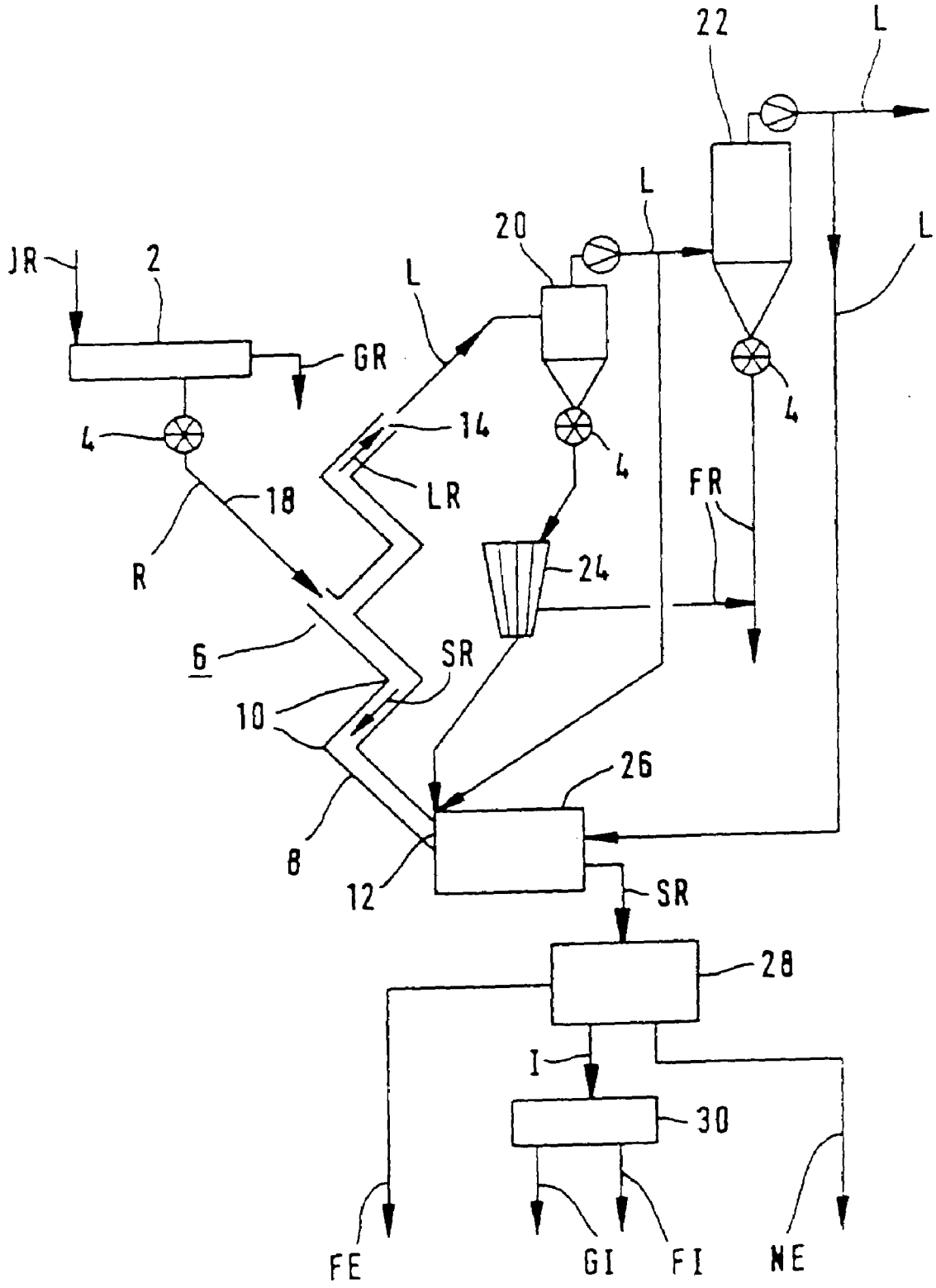
FIG. 1 is a diagrammatic illustration of a plant for the treatment of residue according to the invention.

In all the figures of the drawing, sub-features and integral parts that correspond to one another bear the same reference symbol in each case. Referring now to the figures of the drawing in detail and first, particularly, to FIG. 1 thereof, there is shown an inhomogeneous residue IR being fed to a coarse screen 2 in a plant for treating the inhomogeneous residue IR. The inhomogeneous residue IR is preferably pyrolysis residue from a pyrolysis plant. In the coarse screen 2, the inhomogeneous residue IR is separated into a coarse residue GR and a remainder residue R. The coarse residue fragments GR are for example larger than 200 mm, and are collected and are transported away, as required. The coarse screen 2 is preferably a spiral screen, as illustrated in FIG. 2.

After the bulky constituents have been separated, the residue R is supplied, via a cellular-wheel sluice 4 and via a feed conduit 18, to an air separator designated as a zigzag separator 6. The zigzag separator 6 is configured as a zigzag-shaped duct 8 which extends essentially in the vertical direction and which has a plurality of bends 10. The zigzag separator 6 possesses a lower outlet 12 for heavy residue SR and an upper outlet 14 for light residue LR. Air L flows through the zigzag separator 6 from its lower outlet 12 to its upper outlet 14. The cellular-wheel sluice 4 prevents an air leakage stream out of the zigzag separator 6 from branching off towards the coarse screen 2 via the feed conduit 18.

The light residue LR is entrained to the upper outlet 14 by the airflow, whereas the heavy residue SR settles towards the lower outlet 12. An abrupt change in direction of the flow direction of the air L takes place at each of the bends 10, so that the residue R entrained by the air L is exposed to radial forces. As a result, heavy residual fragments SR impinge, as a rule, against the walls of the duct 8. In particular, sheet-like heavy residue fragments SR, the flat side of which is initially aligned with the air direction and which are therefore first carried along by the air L, despite the fact that their specific gravity is too high, change their alignment with the flowing air L at the bends 10 and fall downwards.

By use of the zigzag separator 6, in particular, dust-containing and carbon-containing constituents are separated as the light residue LR. Impurities which the light residue LR still possesses are light metal or aluminum sheets and fluff or wire fibers. The light residue LR is separated from the air L in a cyclone 20. The air is subsequently purified in a waste-air filter 22 and can then be discharged into the environment or be used as combustion air for a combustion chamber provided in the pyrolysis plant.

The light residue LR separated in the cyclone 20 is supplied via a further cellular-wheel sluice 4 to a centrifugal screen 24. In this, the impurities are separated from the carbon-containing dust constituents and supplied to an air separator drum 26. Moreover, in the centrifugal screen 24, larger carbon-containing residue constituents are comminuted and, together with the carbon-containing dust constituents, are diverted as fine residue FR, together with the fine residue FR recovered from the waste-air filter 22, and, for example, supplied as fuel to a combustion chamber.

In the air separator drum 26 which is connected to the lower outlet 12 of the zigzag separator 6 and to the centrifugal screen 24, the heavy residue SR is circulated, so that light residue constituents LR adhering to the heavy residual fragments are separated. Air L flows through the air separator drum 26 in the direction of the zigzag separator 6 and entrains the light and separated residue constituents LR into the zigzag separator 6.

Figure 5:
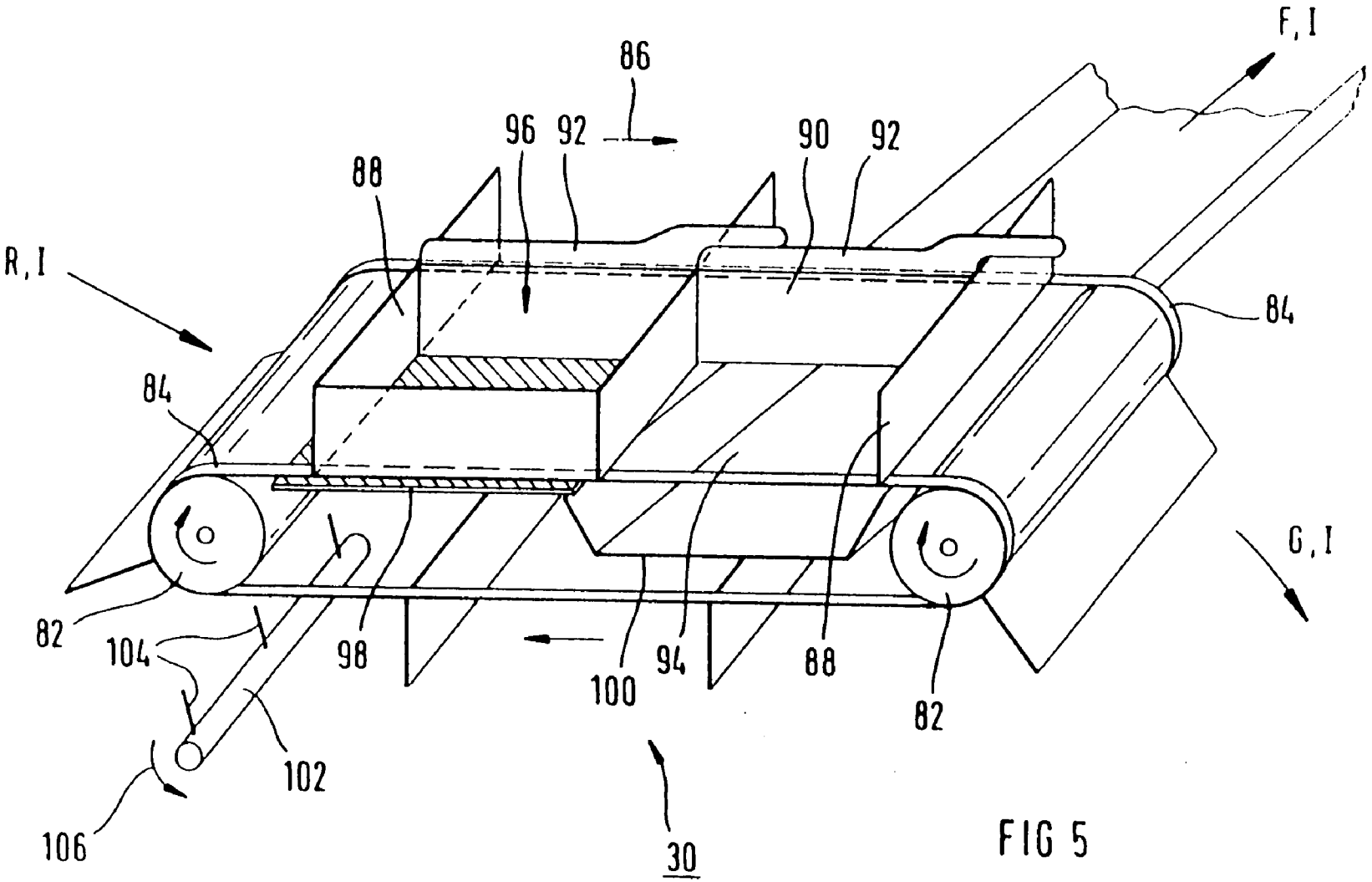
FIG. 5 is a perspective view of an inert screen configured as a chain screen.

The heavy residue SR from the air separator drum 26 is supplied to a separating device 28. In this, separation into a ferrous fraction FE, an inert fraction I and a non-ferrous fraction NE is carried out. The inert fraction I is supplied to an inert screen 30, in which it is separated into a coarse inert fraction GI and a fine inert fraction FI. The inerts of the fine inert fraction FI have, for example, a size of up to a few centimeters and, under certain circumstances, are highly carbon-rich. The fine inert fraction FI is preferably supplied for further inert purification, where the carbon-containing constituents are separated. The inert screen 30 is configured, in particular, as a chain screen, as illustrated in FIG. 5.

The plant described for the treatment of inhomogeneous pyrolysis residue IR makes it possible, by virtue of the special configuration of the individual constituents and their highly expedient arrangement in relation to one another, to achieve substantial separation of the carbon-containing fragments from the remaining residue which can be separated with a high degree of purity, and with fully graded sorting, into an inert fraction I, a ferrous fraction FE and a non-ferrous fraction NE. These useful materials can be reutilized in a suitable way without any further purification.

FIG. 2 shows the coarse screen 2 which is configured as a spiral screen and which contains an aligning device in the form of a drum or rotary tube 32. The latter is inclined relative to the horizontal. A feed device 36 for the residue IR is disposed at one end of the coarse screen 2 and at its opposite end is fastened a spirally wound rod 38 which forms a spiral 40. The spiral 40 is approximately in alignment with the rotary tube 32, so that the diameter of the rotary tube 32 and that of the spiral 40 are approximately equal. At the same time, a longitudinal axis 41 of the rotary tube 32 coincides with a spiral axis 42 of the spiral 40.

The rotary tube 32 is mounted rotatably and can be set in rotation via a drive that is not illustrated in any more detail. The spiral 40 fastened to the rotary tube also rotates together with the latter. According to FIG. 2, the spiral 40 has five turns. The distance between two adjacent turns is preferably about 180 mm. The spirally wound rod 38 is formed of a robust material and, in particular, is metallic. It is, for example, a round iron bar or a steel tube. The spiral 40 is fastened on only one side, specifically to the rotary tube 32. The spiral end facing away from the rotary tube 32 is free of fastening devices and is not supported. The spiral 40 will therefore bend towards its unfastened end due to its own weight. The spiral 40 may also be fastened on both sides. It is preferably bent.

The inhomogeneous residue IR is fed via the feed device 36 and, on account of the inclination of the rotary tube 32 and because of the rotational movement, is transported in a conveying direction 44 towards the spiral 40. In the latter, the coarse residue GR is separated from the remaining residue R, in that only the coarse residue GR is transported further by the spiral 40. An essential advantage of the coarse screen 2 having the spiral 40 is to be seen in that even the coarse residue GR which flows sluggishly is transported in the conveying direction 44 in a simple way as a result of the rotational movement.

By virtue of the rotational movement of the rotary tube 32, elongated residual fragments 46 are aligned in the conveying direction 44, so that they are guided, approximately parallel to the spiral axis 42, into the interior of the spiral 40. This reliably avoids the situation where the elongated residual fragments 46 enter the spiral 40 perpendicularly to the spiral axis 42 and fall through the spiral. Only the fine residue R can therefore fall through the latter, and this is collected in a first collecting container 47 and, if appropriate, transported away. The coarse residue GR is led through the spiral 40 and at its end falls into a second collecting container 48 and is likewise transported away, as required. Instead of the collecting containers 47, 48, conveying devices, such as conveyor belts or conveying worms, may also be provided, in order to transport the residue R, GR away continuously.

An essential aspect of the coarse screen 2 is the bending of the spiral 40, as a result of which the distance between two successive turns changes during the rotational movement. A residual fragment R that has become jammed in the spiral 40 rotates together with the latter and is raised. At the same time, the distance between the turns widens, so that the residual fragment R can fall down. The spiral or coarse screen 2 is therefore largely self-cleaning.

Figure 3:
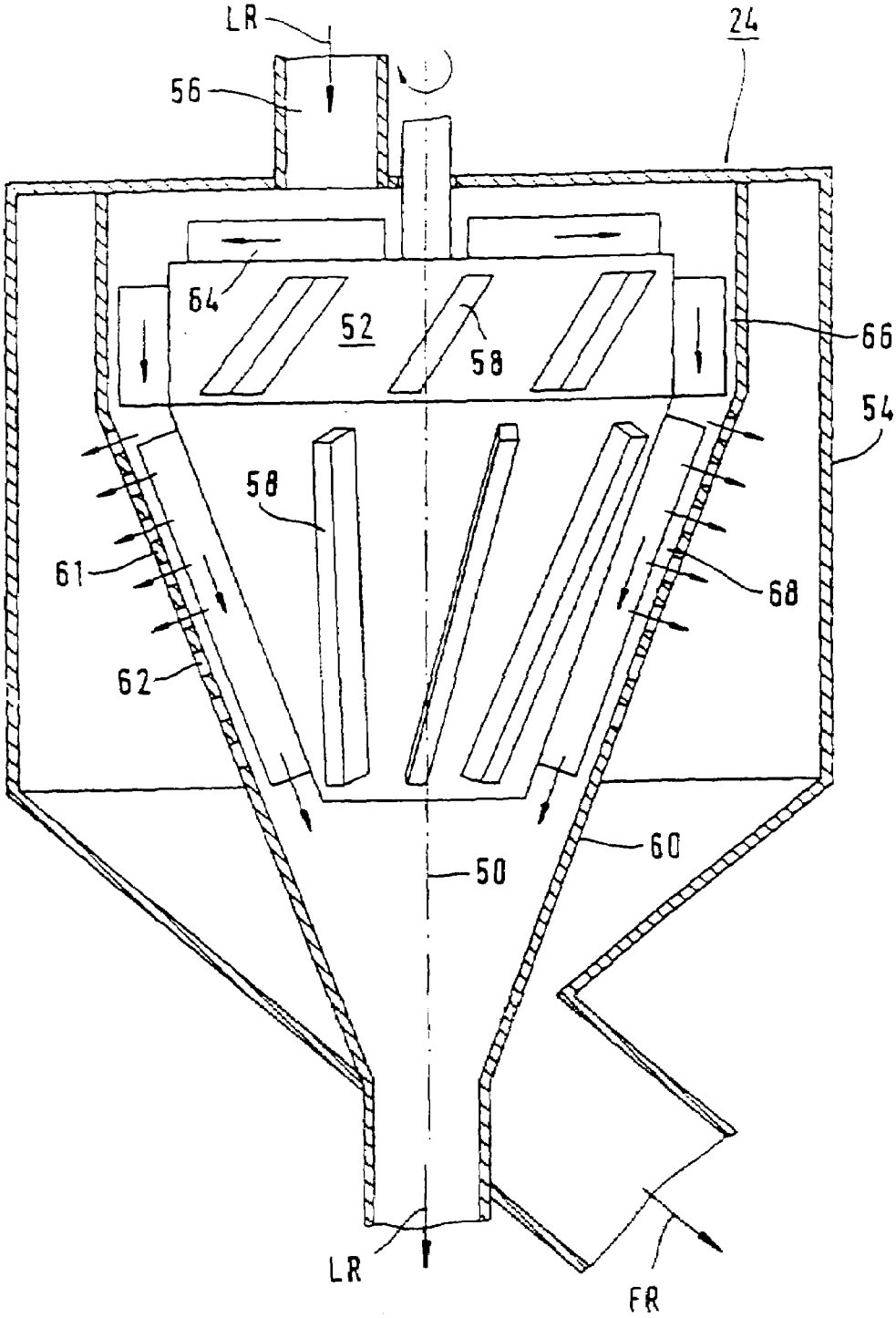
FIG. 3 is a sectional view of a centrifugal screen.

FIG. 3 illustrates the centrifugal screen 24. The centrifugal screen 24 has a rotor 52 that is rotatable about an axis of rotation 50 and is disposed in a housing 54. The light residue LR separated in the cyclone 20 is supplied to the centrifugal screen 24 from above via a feed orifice 56.

The rotor 52 is initially of a cylindrical shape in an upper region and subsequently tapers downwards in the manner of a cone. Battens 58 are disposed on the rotor 52 obliquely to the axis of rotation 50.

Disposed around the rotor 52 is an inner housing 60 which is adapted approximately to the geometry of the rotor 52. The inner housing 60 is configured, in the region of the cone-like rotor 52, as a screen 61 with screen holes 62.

The light residue LR supplied is deflected radially outwards as a result of the rotational movement of the rotor 52 and by guide plates 64 mounted on that end face of the rotor 52 which faces the feed orifice 56. The light residue LR flows from there downwards in a gap formed between the rotor 52 and inner housing 60. The residue, at the same time, passes through a balling zone 66 which is formed in the region of the cylindrical shape of the rotor 52 which is followed by a grinding zone 68.

The light residue LR usually has carbon-containing residual fragments of a size of a few millimeters. It may, however, also have larger carbon-containing solid fragments up to a size of a few tens of millimeters and be contaminated with light sheet-like metal fragments, fluff and fine conductor wires. In the balling zone 66, the impurities are shaped or comminuted into small ball-like particles by the rotational movement and the battens 58. In the grinding zone 68, in particular, the larger carbon-containing residual fragments are ground. The small constituents of the light residue LR which have been fed are separated outwards through the screen holes 62, together with the ground-down carbon-containing constituents, and leave the centrifugal screen 24 as the carbon-containing fine residue FR. The balled impurities are essentially carbon-free, have larger dimensions than the screen holes 62 and leave the centrifugal screen 24 as the light residue LR.

The decisive advantage of the centrifugal screen 24 is to be seen in that the balling zone 66, and, in particular, the destruction of elongated fluff, prevent the screen 61 from being clogged, and in that a carbon-containing fraction is effectively separated as the fine residue FR.

Figure 4:
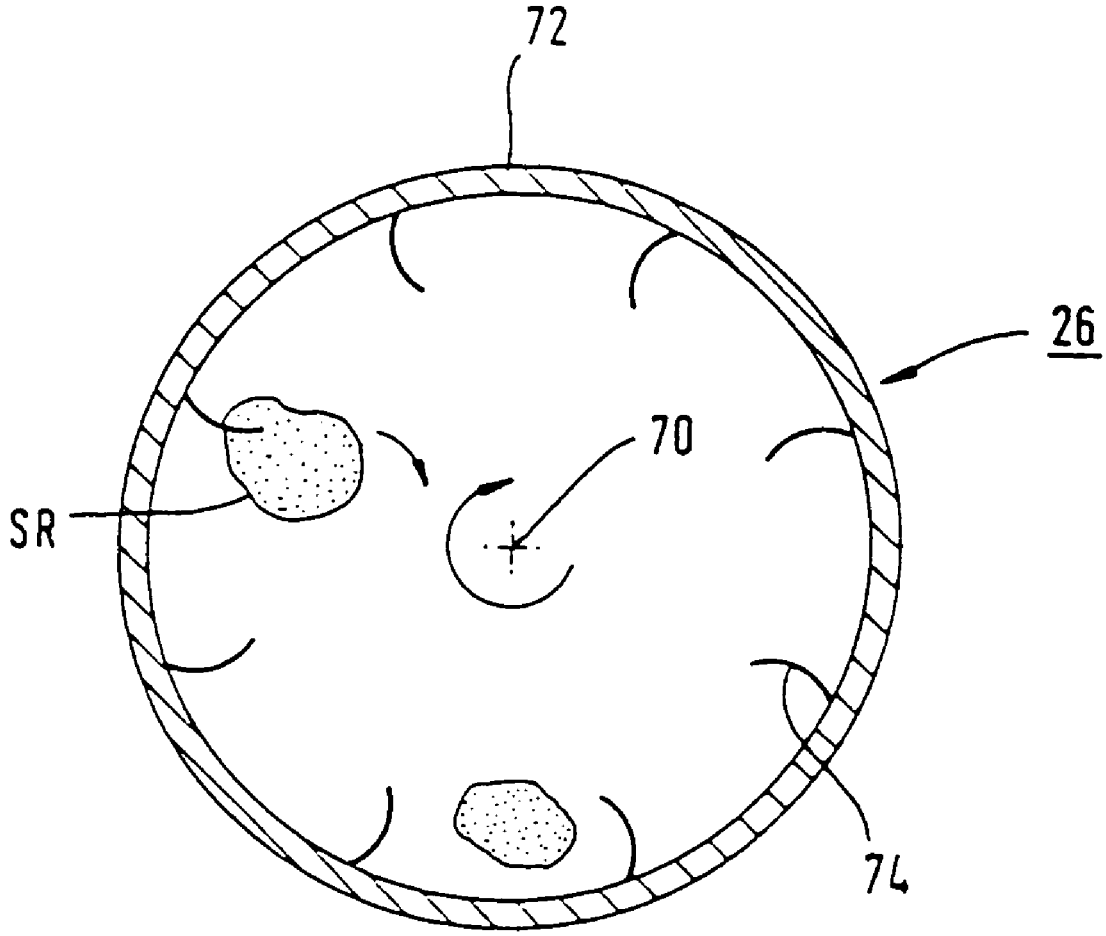
FIG. 4 is a sectional view of an air separator drum.

FIG. 4 shows a section through the air separator drum 26. The air separator drum 26 is rotatable about a drum axis 70 and has on an inner wall of its drum 72, for example, hook-shaped drivers 74. Due to the drivers 74, the heavy residue SR fed into the air separator drum 26 is raised and subsequently falls down again. As a result, light residues LR, which adhere to the heavy residual fragments SR, are released from the latter and are entrained to the zigzag separator 6 by the air flowing through the air separator drum 26.

FIG. 5 shows a perspective illustration of the inert screen 30 configured as a chain screen. It has two deflecting rollers 82 that are spaced from one another and around which two moving belts 84 running parallel to one another rotate. The running direction of the moving belts 84 corresponds to a conveying direction 86 for the residue R fed onto the inert screen 30, in particular for the inert fraction I separated in the separating device 28. Transverse brackets 88 are mounted vertically on the moving belts 84 transversely to the conveying direction 86. The transverse brackets 88 are fastened, in each case on their end faces, to the narrow-band moving belts 84, for example by a welded joint. Disposed between two successive transverse brackets 88 are longitudinal brackets 90, only three of which are shown by way of example. The longitudinal brackets 90 are preferably disposed perpendicularly to the transverse brackets 88 and are fitted into two successive transverse brackets 88. The longitudinal brackets 90 are fastened to one of these two transverse brackets 88. Disposed on the end face of the longitudinal brackets 90 which faces away from the moving belts 84 are battens 92. These are of step-shaped configured, successive battens 92 overlapping one another.

The transverse brackets 88 and the longitudinal brackets 90 form elevations on the moving belts 84, the height of the longitudinal brackets 90 and that of the transverse brackets 88 corresponding essentially to one another. The battens 92 mounted on the longitudinal brackets 90 project beyond the transverse brackets 88.

Figure 2:
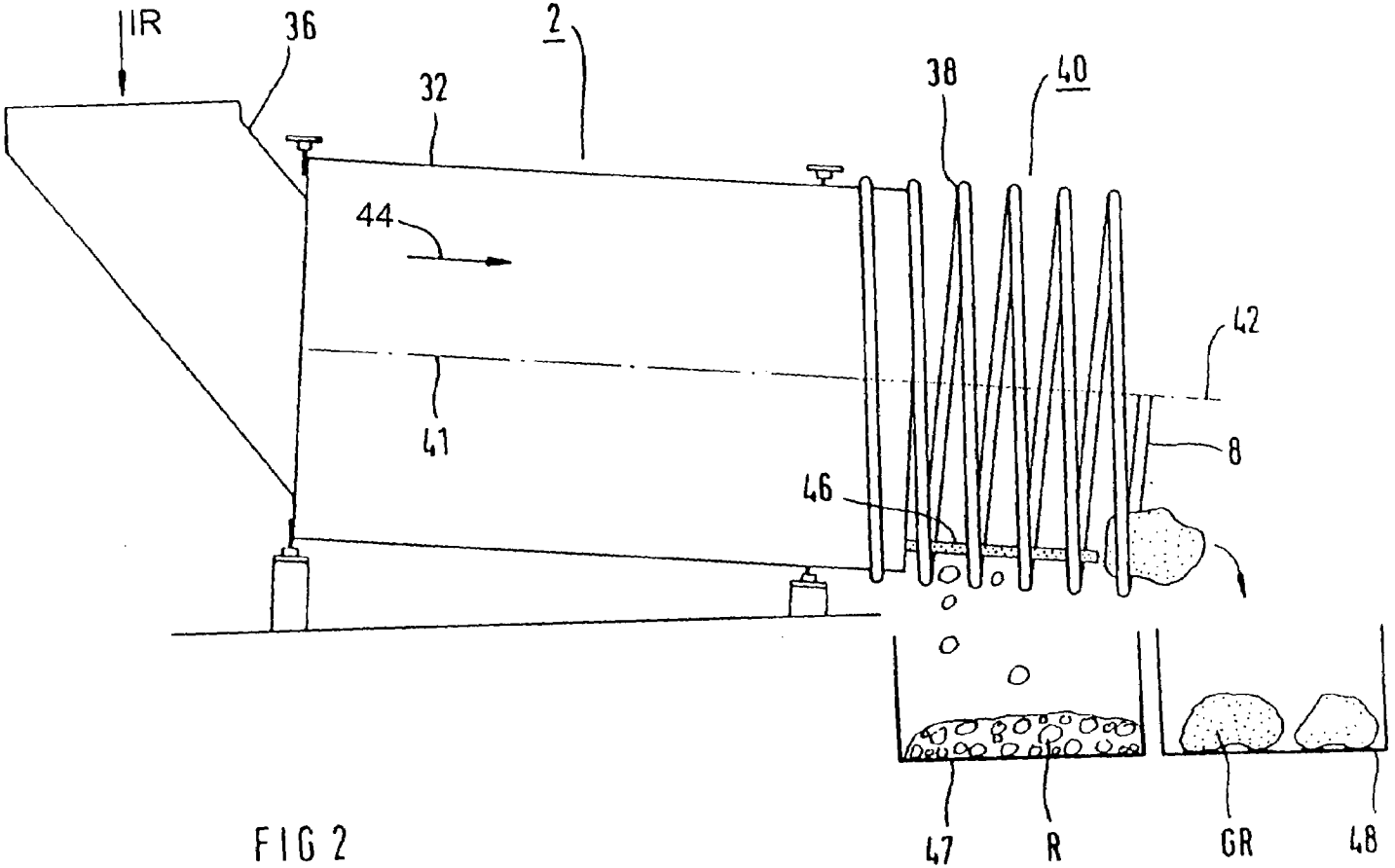
FIG. 2 is an illustration of a coarse screen configured as a spiral screen.

According to FIG. 1, the deflecting rollers 82 are cylinders. Alternatively, a separate pair of the deflecting rollers 82 may be provided for each moving belt 84. For a drive that is as free of slip as possible, the deflecting rollers 82 are configured, for example, as gearwheels which engage into corresponding tooth orifices in the moving belt. The moving belt 84 is produced, for example, from plastic and preferably configured as a chain with metallic chain links.

Since the moving belts 84 are configured to be narrow-band, not sheet-like, there are formed between the moving belts 84 fall-through orifices 94 which are delimited essentially by the transverse brackets 88 and the longitudinal brackets 90. The area spanned by the transverse brackets 88 and longitudinal brackets 90 acts as a screen orifice or as a screen surface 96.

The residue R is fed in a feed region and is transported in the conveying direction 86. In the feed region, an impermeable bottom 98 is disposed directly below the upper portion of the moving belts 84. The bottom 98 has adjoining it a first conveying device 100 for a separated fine inert fraction FI, which is illustrated as a chute running obliquely. Alternatively, it may be configured as an active conveying device in the form of a conveyor belt or a conveying worm.

A cleaning rake 102 with tines 104 is provided below the moving belts 84, in particular at the reversal point of the front deflecting roller 82. The cleaning rake 102 is mounted rotatably about its longitudinal axis, as indicated diagrammatically by the arrow 106.

The residue R applied to the inert screen 30 is separated into a fine inert fraction FI and a coarse inert fraction GI. At the same time, the maximum size of the fine inert fraction FI corresponds to the maximum extent of the screen surfaces 96. Due to the configuration of the impermeable bottom 98, the fine inert fraction first collects, in the feed region, in a kind of screen box which is formed by the longitudinal brackets 90, the transverse brackets 88 and the bottom 98. The accumulated fine inert fraction FI is pushed by the transverse bracket 88 as far as the end of the bottom 98, where it falls through the fall-through orifices 94 onto the first conveying device 100 disposed there. Coarse inert fragments GI, the dimensions of which are larger than those of the screen surfaces 96, remain lying on the longitudinal and transverse brackets 88, 90, are transported further as far as the end of the inert screen 30 and there fall, for example, into a second conveying device which is not illustrated in any more detail.

Residual fragments R having unfavorable dimensions may become jammed between two successive transverse brackets 88. As soon as these transverse brackets 88 arrive at the deflecting roller 82 located on the end face, the distance between the two transverse brackets 88 widens and the jammed residual fragment falls out. Thus, by virtue of the configuration with the rotating moving belts 84, the inert screen 30 automatically removes residual fragments R which are jammed between transverse brackets 88.

Jamming is not possible between the longitudinal brackets 90, since the battens 92 mounted on the longitudinal brackets 90 overlap these. The distance between two battens 92 is therefore shorter than that between two longitudinal brackets 90, so that residual fragments R can be jammed only between the battens 92. A residual fragment R jammed between two battens 92 disposed next to one another is entrained as far as the cleaning rake 102 and is released there with the aid of the tines 104. In this case, the tines 104 engage into the interspaces formed by the longitudinal brackets. The inert screen 30 is therefore configured to be self-cleaning even for residual fragments R jammed between the battens 92.

Other advantageous embodiments of the inert screen 30 may be gathered from the German Patent application already mentioned, bearing the official file number 198 23 019.2, to which reference is hereby made as an integral part of this description. The same applies to the coarse screen 2, the special configuration of which may be gathered from the German Patent application bearing the official file number 198 23 018.4 and is hereby incorporated by reference.

We claim:

1. A treatment plant, comprising:

a coarse screen receiving an inhomogeneous residue from a thermal waste disposal plant, said coarse screen separating the inhomogeneous residue into a coarse residue and a remaining residue;

an air separator disposed downstream of said coarse screen and receiving the remaining residue, said air separator having a zigzag-shaped duct with an upper outlet and a lower outlet and through which air is capable of flowing, said zigzag-shaped duct separating the remaining residue into a light residue flowing toward said upper outlet and a heavy residue flowing toward said lower outlet; and an air separator drum connected to said lower outlet and through which the air can flow, said air separator drum having a longitudinal axis, an inner wall, and drivers disposed on said inner wall, said air separator drum mounted rotatably about said longitudinal axis.

2. The plant according to claim 1, including a centrifugal screen connected to said upper outlet, said centrifugal screen having a housing, a rotor disposed in said housing, and a screen disposed between said rotor and said housing.

3. The plant according to claim 2, wherein said centrifugal screen has battens fastened to said rotor.

4. The plant according to claim 2, wherein said centrifugal screen has a balling zone and a grinding zone, and said screen is disposed around said rotor in a region of said grinding zone.

5. The plant according claim 1, including a separating device for separating the heavy residue into an inert fraction and into at least one metal fraction, said separating device disposed downstream of said air separator drum.

6. The plant according to claim 1, wherein the thermal waste disposal plant is a pyrolysis plant.

7. The plant according claim 5, wherein the at least one metal fraction includes a ferrous fraction and a non-ferrous fraction.

* * * * *